United States Patent [19]

Grant

[11] 4,425,997

[45] Jan. 17, 1984

[54] ARTICLE DISPLAY AND HOLDER APPARATUS

[76] Inventor: Robert F. Grant, 3234 S. Cuyler Ave., Berwyn, Ill. 60402

[21] Appl. No.: 430,526

[22] Filed: Sep. 30, 1982

[51] Int. Cl.[3] ..... B65D 1/36; B65D 85/58; A45C 11/00

[52] U.S. Cl. ..... 206/0.84; 206/0.82; 206/456; 206/45.31; 220/4 B; 220/4 E; 220/21

[58] Field of Search ..... 206/0.82, 0.83, 0.84, 206/456; 220/4 E, 4 B, 21

[56] References Cited

U.S. PATENT DOCUMENTS

| | | | |
|---|---|---|---|
| 2,457,998 | 1/1949 | Hayes et al. . | |
| 2,571,073 | 10/1951 | Stroop . | |
| 2,597,227 | 5/1952 | Colliton . | |
| 2,633,980 | 4/1953 | Jorgensen | 206/456 |
| 2,968,882 | 1/1961 | Ozeki | 206/456 |
| 3,100,567 | 8/1963 | Levy | 206/0.82 |
| 3,193,090 | 7/1965 | Hudgeons et al. . | |
| 3,229,809 | 1/1966 | Spadaro . | |
| 3,302,773 | 2/1967 | Weir et al. . | |
| 3,788,464 | 1/1974 | Skinner . | |
| 3,809,217 | 5/1974 | Harrison . | |
| 4,077,515 | 3/1978 | Shoberg | 220/4 E |
| 4,207,980 | 6/1980 | Namiki | 206/456 |
| 4,236,635 | 12/1980 | Namiki | 206/456 |

*Primary Examiner*—William T. Dixson, Jr.
*Attorney, Agent, or Firm*—Leonard J. Kalinowski

[57] ABSTRACT

A display and storage device for articles such as coins, medals, tokens and the like includes a pair of plate members, identical in size and configuration, which are adapted to be assembled together by way of complimentary ridges and channels which become aligned when the two plate members are placed together in a particular orientation. An article to be stored is placed between a pair of flexible transparent sheets which in turn are positioned between the plate members, the edges of the sheets being compressed together by the plate members when they are assembled. A plurality of the storage devices may be mounted on an apertured display board.

6 Claims, 7 Drawing Figures

ARTICLE DISPLAY AND HOLDER APPARATUS

BACKGROUND OF THE INVENTION

This invention relates to article display and storage devices, and more particularly to a two-piece storage device adapted to receive a small article, such as a coin, a medal, a token or the like, and provide a substantially airtight enclosure for enclosing the article.

Various display devices have been proposed for storing articles, such as coins, tokens, medals, stamps, and the like which comprise a collection of such articles. For example, in coin collecting, one of the most widely used coin holders is the Whitman holder which comprises a heavy paper or cardboard booklet having a plurality of leaves each of which comprises a heavy pressed paper page, which is apertured to permit display of both sides of the coins. The coins are held in place by plastic sleeves which are inserted between the board and an attached paper lamination. It is known that coins stored in such storage devices are subject to tarnish from prolonged contact with the paper which comprises the leaves of the album. In addition, the plastic sleeve does not provide an airtight seal for the coins, and accordingly, the coins are subject to tarnish from contaminents in the air.

Other coin holders have been developed to protect coins from adverse affects from the atmosphere so as to prevent tarnishing and other damaging affects on the coin. These holders are generally in the form of two complimentary mating plates adapted to be interlocked with one another defining an airtight compartment for a coin. One such holder, disclosed in the U.S. Pat. No. 3,229,809 to G. I. Spadaro, includes a pair of mating parts which together form a display chamber for a coin. Each plate has an inwardly projecting ridge, the ridges being received in telescopic engagement when the parts are assembled together to define the display chamber. Recessed window portions are centrally located on the outer surfaces of the parts to enhance viewability of the article contained within the holder when it is assembled.

Another coin holder shown in U.S. Pat. No. 3,100,567 to M. Levy comprises two hinged plates adapted to enclose an envelope of flexible plastic film material sealed along three sides leaving one side unfastened to permit insertion of a coin. The edges of the envelope which contains the coin are clamped between the complimentary plates providing a substantially airtight seal when the coin holder is assembled.

The coin holder shown in the 3,229,809 Patent provides the airtight chamber for the coin by virtue of the telescoping ridges. Thus, a high degree of accuracy in the molding of the front and rear parts of the container would be necessary to ensure that the internal projecting ridges are in engagement substantially along their entire extent when the two parts are assembled together to provide a frictionally formed seal for the chamber and which prevents the passage of air into the chamber. The coin holders shown in the 3,100,567 Patent include a plastic envelope for containing a coin, the edges of the envelope being clamped between the complimentary plates when they are assembled together. Although this arrangement relaxes the tolerances required to ensure an airtight seal for the envelope containing the coin, the coin holder itself, by virtue of its hinged construction and its coacting ridges and notches formed along the edges of the two plates, represents a fairly complicated article from a manufacturing standpoint and one which is susceptible to damage.

SUMMARY OF THE INVENTION

The present invention provides a display and storage device for an article which provides a substantially airtight container for the article. The storage device is simple and rugged in construction, and inexpensive to manufacture.

In accordance with the invention, the display and storage device comprises a pair of mating plate members which are of identical dimension and configuration. The plate members have a central aperture, the central apertures being aligned with one another defining a viewing window when the plate members are assembled together. The holder further comprises a pair of sheets of a transparent flexible material. The article to be displayed is placed between the two thin sheets, and the sheets are assembled between the two plate members, the plate members being adapted to clamp together the edges of the flexible sheets to provide an airtight container for the article.

The plate members have coacting ridges and channels which interlock with one another to hold the plates together. As indicated, the two plate members which comprise the holder are indentical in dimensions and configuration. However, for each plate member, the ridges extend along one pair of opposite edges and the channels extend along the other pair of opposite edges so that when the plate members are assembled together with their inner surfaces opposing one another, and with one of the plate members rotated 90° about an axis perpendicular to the inner surface of the other plate member, the ridges of each plate member are received in frictional engagement with the channels of the other plate member, holding the plate members together. In accordance with a feature of the invention, alignment means, in the form of pin/hole pairs is provided for locating the sheets of flexible material in place during assembly of the storage device and also to facilitate alignment of the ridges with the channels during assembly.

The display and storage device provided by the present invention affords considerable savings in production costs since identical plate members are used to form the two part holder. It is evident that when the parts are manufactured from a plastic material using injection molding techniques, only a single mold need be made, thereby cutting the start-up costs in half. Further savings are achieved in production as well as in packaging operations.

Moreover, the storage device is simple and rugged in construction. The indexing pin and the ridges which serve in retaining the assembled parts together are disposed on the inner surface of the plate members and within the peripheral edges thereof. Consequently, there is less chance of damage than would be the case if the interlocking elements were located at the edge of the plate member.

In accordance with another aspect of the invention, a plurality of the storage assemblies are mounted on an apertured display or mounting board. In one mounting arrangement, each storage assembly is received in an aperture of the board and is maintained in the aperture by means of flexible flanges. In a further embodiment, projections formed on sidewall surfaces of the mounting board apertures secure each storage assembly to the board.

DESCRIPTION OF PREFERRED EMBODIMENTS

Figure 1:
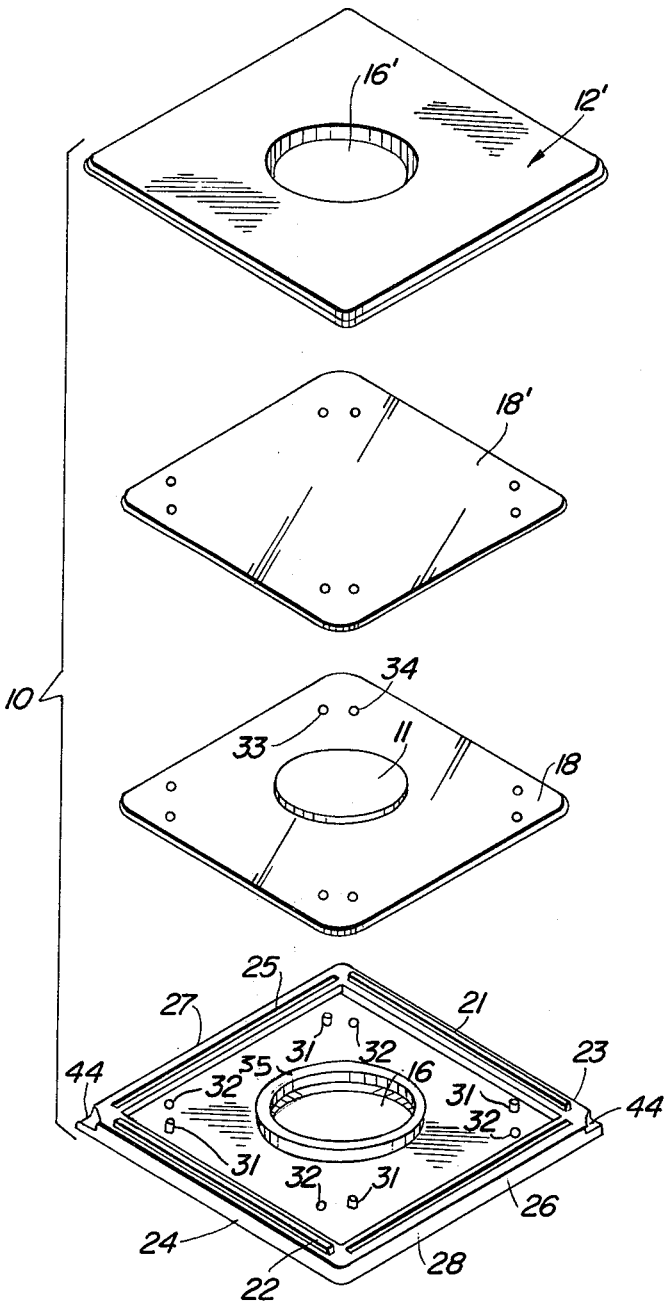
FIG. 1 is an exploded perspective view of the embodiment for an article storage device provided by the present invention.

Referring to the drawings, FIG. 1 is an exploded perspective view of one embodiment for an article storage device 10 provided by the present invention. The article storage device 10 may be used to store a disc-type article 11, such as a coin, medal, a token or the like.

Briefly, the article display and storage holder comprises a pair of mating plate members 12 and 12' which are of identical dimensions and configuration, and each having a circular opening 16 constituting a window centrally of each plate member. The article 11 to be displayed is located within this window when the holder is assembled. The article is received between a pair of identical sheets of flexible plastic film material 18 and 18' which in turn are received and compressed along their edges between the plate members 12 and 12' when the plate members are assembled together. Since the plate members 12 and 12' are identical corresponding parts have been given the same reference number, but with a prime notation for the elements of member 12'.

More specifically, each plate member, such as plate member 12 includes a pair of ridges 21, 22 which extend parallel to one another along the inner surface of the plate 12 adjacent to opposite edges 23, 24, respectively of the plate member. The plate member 12 also has a pair of channels 25 and 26 which extend parallel to one another adjacent to opposite edges 27 and 28, respectively of the member 12. As will be shown, the ridges and channels of the two plate members coact to hold the plate members together when the holder is assembled. In addition, a pin 31 and a hole 32 pair is provided near each of the four corners of the member 12 to align the transparent windows 18 and 18' to the plates 12 and 12' and affix them thereto. Each sheet 18 has a pair of apertures or locator holes, such as apertures 33 and 34 in sheet 18 which are aligned with the corresponding pin/-hole pairs, of member 12. An annular shoulder 35 extends around the central aperture 16, and, cooperates with an identical shoulder 35', (FIG. 2A) on the other plate member 12' to compress the edges of the two plastic film sheet members 18 and 18' together when the plate members are assembled together. Tapered corner portions 44 of plate member 12 are aligned with corresponding tapered corner portions 44' of plate member 12' to define fingernail holes at opposite corners of the holder to facilitate separation of the plate members from one another.

Figure 2:
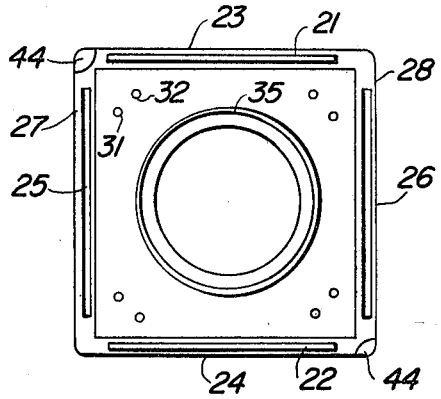
FIGS. 2 and 2A are top plan views of the inside surface of the top and bottom members of the article storage device of FIG. 1.
Figure 2A:
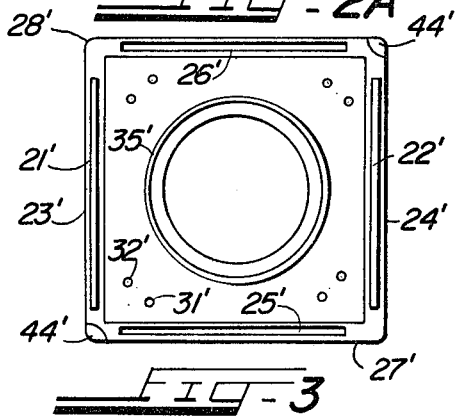

Referring now to FIGS. 2 and 2A, as indicated above, the plate members 12 and 12' are identical in configuration and dimensions. FIG. 2 is a plan view of the inner surface of plate member 12, with its edge 23 being located at the top of FIG. 2 and edge 24 being located at the bottom portion of FIG. 2. Sides 27 and 28 of member 12 are located at the left and right hand portions of FIG. 2, respectively. FIG. 2A shows a plan view of the inner surface of the other plate member 12'. The plate member 12' has been rotated 90° relative to the orientation of member 12 in FIG. 2, such that its edges 28' and 27' are located near the top and bottom portions, respectively, of FIG. 2A and its edges 23' and 24' are located in the left and right hand portions, respectively, of FIG. 2A.

By comparing FIGS. 2 and 2A, it is seen that the ridges 21 and 22 of the member 12 are aligned edgewise with channels 26' and 25' of member 12', and the channels 25 and 26 of member 12 are aligned, edgewise, with ridges 21' and 22' of member 12'. Likewise, pin 31 and hole 32 located near the top left side of member 12 are aligned with hole 32' and pin 31', respectively, located near the lower left corner of member 12'.

In assembling display device, sheet 18 is placed on the inner surface of plate member 12 with the pins 31 extending through the locator holes 33. The article 11 is then placed on the sheet 18 to overlie the aperture 16. Then the other sheet 18' is placed on sheet 18 with its locator holes threading the pins 31. Finally, the plate member 12' is pressed onto member 12. In assembling the two plate members, the plate members are arranged in position with their inner surfaces facing one another and with 90° difference in orientation of the edges of one member relative to those of the other member. For example, edges 28', 24', 27' and 23' of member 12' would overlie edges 24, 28, 23 and 27, respectively of member 12. With this orientation, complimentary elements, i.e. ridges and channels or pins and holes, of the two members 12 and 12' overlie one another. When the two members 12 and 12' are pressed together, ridge 21 is received in channel 25'; channel 26 receives ridge 22', etc. Also, pin 31 of member 12 extends through apertures 33 in the two sheets 18 and 18' (FIG. 1) and is received in hole 32 in member 12'. Similarly, pin 31' of member 12' extends through apertures 34 in sheets 18 and 18' and is received in hole 32 in member 12.

Figure 3:
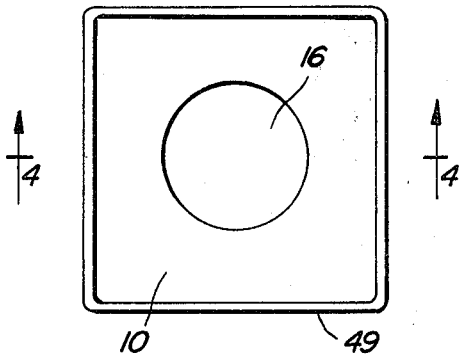
FIG. 3 is an elevational view of the article storage assembly of FIG. 1 shown assembled.
Figure 4:
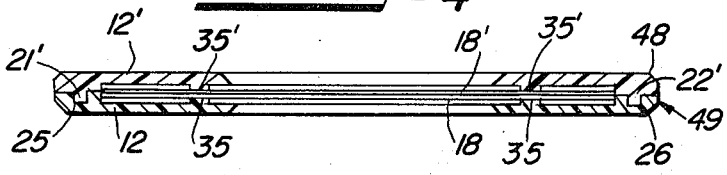
FIG. 4 is a sectional view taken along lines 4—4 of FIG. 3.

When the plate members are assembled together as shown in FIG. 3, the article being displayed is located within the aperture 16 but enclosed within the two plastic sheets. As can be seen in FIG. 4, the edges of the sheets are pressed together between the inner surfaces of the annular rings which encircle the central aperture 16 of the inner surfaces of the two plate members. This clamps the two sheets 18 and 18' along all four edges defining a closed envelope for the article 11. As illustrated in FIG. 4, ridges 21' and 22' of member 12 are received in respective channels 25 and 26 of member 12, (and although not shown ridges 21 and 22 of member 12 are received in channels 25' and 26', respectively, of member 12') providing a friction fit to maintain the two members 12 and 12' interlocked together.

As shown in FIG. 4, the edges 48 of the two members 12 and 12' when assembled are tapered defining a beveled edge 49 which extends around the entire periphery of the holder.

Figure 5:
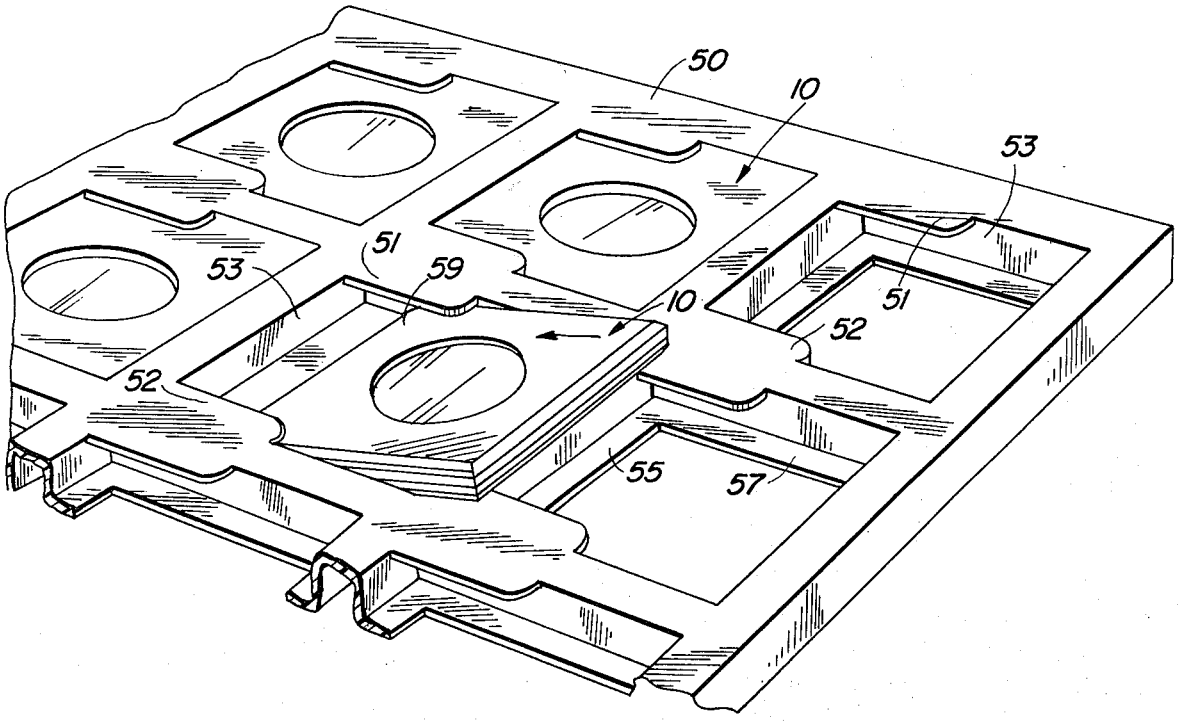
FIG. 5 is a perspective view of a display assembly illustrating a portion of a display board which mounts a plurality of the article storage devices.

The storage device 10 provides for storage of a single article 11, and also is adapted to be mounted on a suitable mounting or display board, such as mounting board 50 shown in FIG. 5, along with a plurality of like or similar article storage devices to provide a unitary display assembly for a plurality of articles. The mounting board 50 is of a flexible plastic material, which may be transparent or opaque, and has a pair of flexible flanges at opposite edges of each of a plurality of apertures, such as flanges 51 and 52 for aperture 53 for retaining the storage device 10 on the board. The flanges 51 and 52 each comprise a generally rectangular strip which is integrally formed with the aperture defining edges of the board and located at the top surface of the board to overlie the upper surface of the storage device 10. A peripheral shoulder 55 located at the bottom surface of the board and extending inwardly into the aperture, provides a support for the bottom edge of the storage device 10 as well as defining an open bottom to expose to view the underside of the device. The distance between the lower surface of the flanges 51 and 52 and the upper surface 57 of the shoulder 55 corresponds to the height or thickness of the storage device 10.

To mount a storage device on the display board, the storage device 10 is tilted and positioned with a leading edge 59 located between the flanges 51, 52 and the shoulder 55. The device 10 is then moved in the direction of the arrow while its leading edge 59 is rotated downwardly. The flanges 51 and 52 will flex upwardly, somewhat as the storage device is slipped into place with its bottom edge surface resting on shoulder 55 and its upper surface beneath flanges 51 and 52. Removal of the storage device from the mounting board is effected by applying thumb pressure to the underside of the device near the edge opposite that which is located beneath the flanges.

Figure 6:
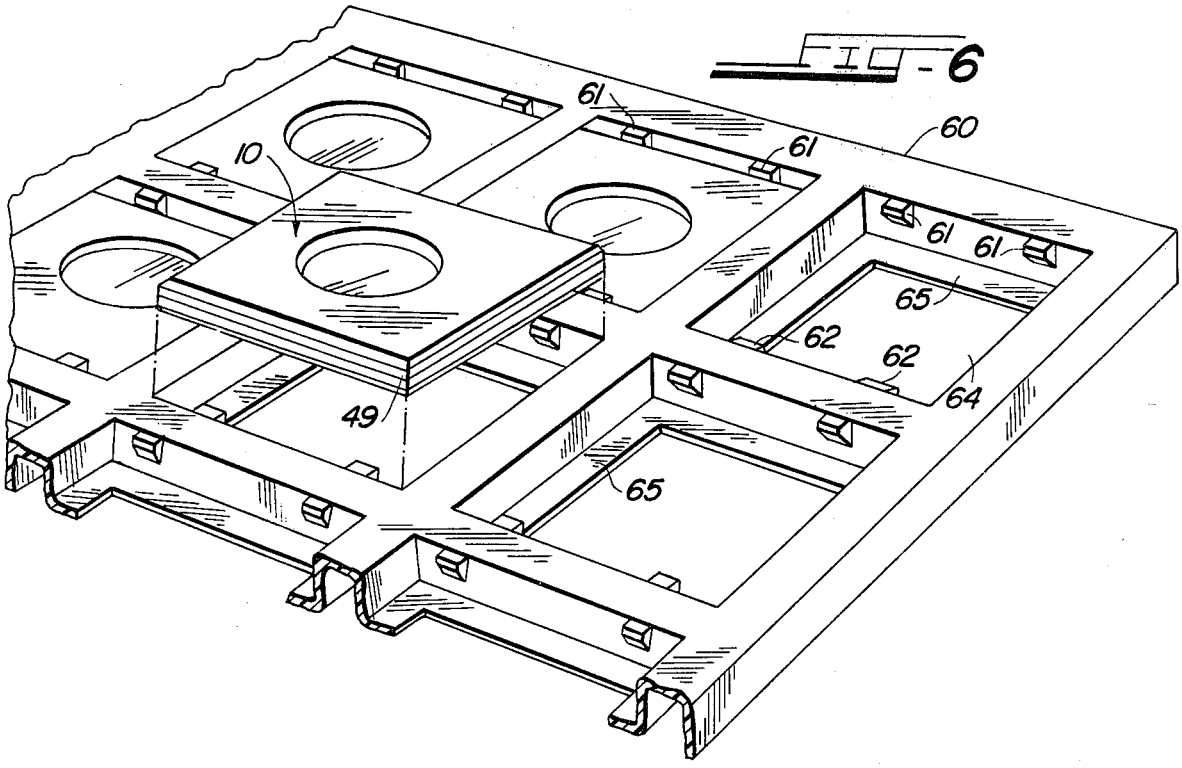
FIG. 6 is a perspective view of another embodiment of a display assembly illustrating a portion of a display board for mounting a plurality of the article storage devices.

In another embodiment for a mounting board 60, shown in FIG. 6, a pair of projections 61, 62 are provided on two opposing inner side surfaces of the apertures 64. The projections, which are in the form of a truncated pyramid, engage the upper surface the beveled edges 49 of the article storage device 10 when the device is positioned within the aperture 64, such that the device 10 is clamped between the projections 61, 62 and the supporting shoulder 65. The device can be removed by applying finger pressure against the bottom surface of the holder.

I claim:

1. A display and storage device for an article comprising: enclosing means for receiving an article therewithin, and a receptacle including first and second separate plate members adapted to be removably assembled together with said enclosing means contained between said plate members, said plate members each having a central aperture defining viewing windows for an article, said first and second plate members being rectangular in shape and identical in size and configuration with each plate member having a generally planar inner surface with first and second ridges and first and second channels, the first and second ridges being located adjacent to first and second opposing edges, respectively, of the plate member and extending parallel to one another and to said first and second edges, and the first and second channels being located adjacent to third and fourth opposing edges, respectively, of the plate member and extending parallel to one another and to said third and fourth edges, the first and second plates being assembled together with their inner surfaces opposing one another and with the first and second edges of the first plate member overlying the third and fourth edges of said second plate member whereby the ridges of the first plate member are received in frictional engagement with the channels of the second plate member and the ridges of the second plate member are received in frictional engagement with the channels of the first plate member to hold the plate members together.

2. A display and storage device according to claim 1 wherein said enclosing means comprises first and second separate sheets of a transparent flexible material, said plate members each including indexing means for locating said sheets at a desired position between said plate members and in an overlying relationship, one with the other, and said inner surfaces of said plate members defining raised portions which compress together the edges of said first and second sheets when the plate members are assembled.

3. A display and storage device according to claim 2 wherein said indexing means comprises a plurality of pin/hole pairs on each of said plate members, said first and second sheets each having a plurality of pairs of locator holes, the pins of each plate member threading the locator holes of said first and second sheets and being received in the hole of the other plate member when the plate members are assembled together.

4. In a display assembly for an article, the combination comprising: enclosing means for receiving an article therewithin, and a receptacle including first and second separate plate members adapted to be removably assembled together with said enclosing means contained between said plate members, said plate members each having a central aperture defining viewing windows for an article, said first and second plate members being rectangular in shape and identical in size and configuration with each plate member having a generally planar inner surface with first and second ridges and first and second channels, the first and second ridges being located adjacent to first and second opposing edges, respectively, of the plate member and extending parallel to one another and to said first and second edges, and the first and second channels being located adjacent to third and fourth opposing edges, respectively, of the plate member and extending parallel to one another and to said third and fourth edges, the first and second plates being assembled together with their inner surfaces opposing one another and with the first and second edges of the first plate member overlying the third and fourth edges of said second plate member whereby the ridges of the first plate member are received in frictional engagement with the channels of the second plate member and the ridges of the second plate member are received in frictional engagement with the channels of the first plate member to hold the plate members together therewithin, said mounting board having a shoulder portion located near its lower surface and extending into said aperture for supporting the bottom edge of said receptacle when it is positioned within said aperture, and said mounting board having a plurality of projecting portions located near its upper surface and projecting into engagement with a surface of said receptacle adjacent to its edge when said receptacle is positioned within said aperture, for securing said receptacle to said mounting board.

5. An assembly according to claim 4 wherein said projecting portions of said mounting board comprise a pair of flanges of a flexible material which overlie the aperture and project into engagement with the upper surface of said receptacle when it is positioned within the aperture.

6. An assembly according to claim 4 wherein said projecting portions of said mounting board comprise rib members in the form of truncated pyramids, first and second pairs of said rib members being located on first and second opposing side walls of the aperture, and said receptacle having beveled edge which are engaged by said rib members when the receptacle is positioned within the aperture.

* * * * *